US009881539B2

(12) United States Patent
Jin et al.

(10) Patent No.: US 9,881,539 B2
(45) Date of Patent: Jan. 30, 2018

(54) DISPLAY SUBSTRATE AND DRIVING METHOD THEREOF AS WELL AS DISPLAY APPARATUS

(71) Applicant: Boe Technology Group Co., Ltd., Beijing (CN)

(72) Inventors: Xiaodan Jin, Beijing (CN); Lintao Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 35 days.

(21) Appl. No.: 14/905,371

(22) PCT Filed: Jul. 17, 2015

(86) PCT No.: PCT/CN2015/084285
§ 371 (c)(1),
(2) Date: Jan. 15, 2016

(87) PCT Pub. No.: WO2016/127574
PCT Pub. Date: Aug. 18, 2016

(65) Prior Publication Data

US 2016/0372019 A1 Dec. 22, 2016

(30) Foreign Application Priority Data

Feb. 13, 2015 (CN) ..... 2015 1 0079588

(51) Int. Cl.
*G09G 3/20* (2006.01)

(52) U.S. Cl.
CPC ..... *G09G 3/2003* (2013.01); *G09G 3/20* (2013.01); *G09G 2300/0426* (2013.01); *G09G 2300/0452* (2013.01); *G09G 2300/0465* (2013.01)

(58) Field of Classification Search
CPC ..... G09G 3/2003; G09G 3/20; G09G 3/3607; G09G 2300/0426; G09G 2300/0452;
(Continued)

(56) References Cited

U.S. PATENT DOCUMENTS 8,552,635 B2 * 10/2013 Kim ..... G09G 3/2003 313/504
9,262,957 B2 * 2/2016 Yang ..... G09G 3/2003
(Continued)

FOREIGN PATENT DOCUMENTS

CN 102262854 11/2011
CN 104009063 8/2014
(Continued)

OTHER PUBLICATIONS

International Search Report and Written Opinion from PCT/CN2015/084285 dated Nov. 11, 2015.
(Continued)

*Primary Examiner* — Tom Sheng
(74) *Attorney, Agent, or Firm* — Calfee, Halter & Griswold LLP

(57) ABSTRACT

A display substrate and a driving method thereof as well as a display apparatus. The display substrate comprises pixel groups which are arranged repeatedly, each pixel group comprising a first sub-pixel group and a second sub-pixel group, each comprising four pixel columns. The present invention reduces the number of sub-pixels in the whole display apparatus. Therefore, on a premise of ensuring that the display apparatus achieves a relatively high resolution, the fabrication difficulty of the display apparatus is reduced, and the cost is lowered.

13 Claims, 1 Drawing Sheet

(58) Field of Classification Search
CPC .... G09G 2300/0465; G09G 2340/0457; H01L 27/3216; H01L 27/3218; G02F 2001/134345
See application file for complete search history.

(56) References Cited

U.S. PATENT DOCUMENTS

2003/0128225 A1* 7/2003 Credelle ..... G02F 1/133514 345/694
2004/0080479 A1* 4/2004 Credelle ..... G02F 1/133514 345/88
2005/0168423 A1* 8/2005 Hirata ..... G09G 3/2003 345/88
2010/0118045 A1* 5/2010 Brown Elliott .... G02B 27/2214 345/589
2011/0291549 A1 12/2011 Kim
2012/0262362 A1* 10/2012 Uehara ..... G02B 27/2214 345/88
2013/0106891 A1* 5/2013 Matsueda ..... G09G 3/2003 345/589
2014/0198479 A1* 7/2014 Chao ..... H01L 27/3218 362/84
2014/0204008 A1* 7/2014 Chu-Ke ..... G09G 3/2003 345/88
2015/0302808 A1* 10/2015 Wang ..... G02F 1/1335 345/691
2015/0309360 A1* 10/2015 Wang ..... G09G 3/3607 345/694
2015/0364075 A1* 12/2015 Sato ..... G09G 3/007 345/698
2016/0155397 A1* 6/2016 Yang ..... G09G 3/3607 345/87
2016/0171917 A1* 6/2016 Yang ..... G09G 3/2003 345/694
2016/0358540 A1* 12/2016 Jin ..... G09G 3/3208
2016/0372020 A1* 12/2016 Jin ..... G09G 3/20

FOREIGN PATENT DOCUMENTS

| | | |
|---|---|---|
| CN | 104009064 | 8/2014 |
| CN | 104009066 | 8/2014 |
| CN | 104166260 | 11/2014 |
| CN | 104599599 | 5/2015 |
| CN | 104614882 | 5/2015 |
| CN | 104616597 | 5/2015 |
| JP | 2006018090 | 1/2006 |
| KR | 20110117612 | 10/2011 |
| KR | 20140116805 | 10/2014 |
| WO | 2007/034618 | 3/2007 |

OTHER PUBLICATIONS

Office Action from China Application No. 201510079588.9 dated Feb. 27, 2017.

* cited by examiner

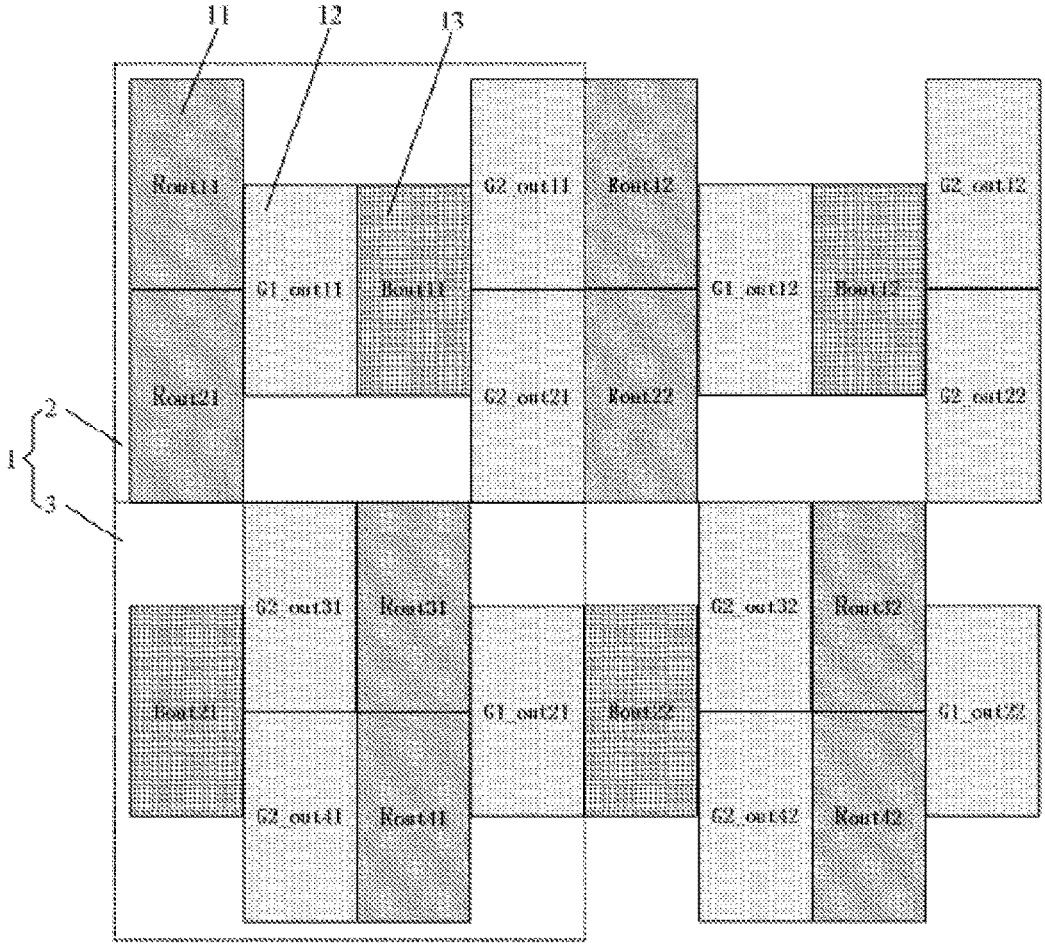
11
12
13
Rout11
G1_out11
Rout13
G2_out11
Rout12
G1_out12
Rout12
G2_out12
Rout21
G2_out21
Rout22
G2_out22
1
2
3
G2_out31
Rout31
Rout21
G1_out21
Rout22
G2_out32
Rout32
G1_out22
G2_out41
Rout41
G2_out42
Rout42

DISPLAY SUBSTRATE AND DRIVING METHOD THEREOF AS WELL AS DISPLAY APPARATUS

RELATED APPLICATION

The present application is the U.S. national phase entry of PCT/CN2015/084285, with an international filling date of Jul. 17, 2015, which claims the benefit of Chinese Patent Application No. 201510079588.9, filed on Feb. 13, 2015, the entire disclosures of which are incorporated herein by reference.

TECHNICAL FIELD

The present invention relates to the technical field of display, and particularly relates to a display substrate and a driving method thereof as well as a display apparatus.

BACKGROUND ART

A conventional display apparatus performs display by forming one pixel from sub-pixels of three colors: red, green and blue (RGB). In a practical application, a resolution of the display apparatus may be increased by increasing pixels per inch (abbreviated PPI) on the display apparatus.

At present, RG/BG is a frequently-used pixel arrangement for realizing a high resolution by using fewer sub-pixels. However, with an increasing requirement for a resolution of the display apparatus, such a RG/BG sub-pixel arrangement faces a greater challenge. To increase the resolution of the display apparatus, it is necessary to increase the number of sub-pixels, which may cause problems such as large fabrication difficulty of the display apparatus, high cost and the like.

SUMMARY OF THE INVENTION

The present invention provides a display substrate and a driving method thereof as well as a display apparatus, for reducing the fabrication difficulty of the display apparatus and lowering the cost.

To achieve the above objective, the present invention provides a display substrate, comprising pixel groups which are arranged repeatedly, each pixel group comprising a first sub-pixel group and a second sub-pixel group, the first sub-pixel group and the second sub-pixel group both comprising four pixel columns.

Two first sub-pixels which are sequentially arranged are disposed in a first pixel column of the first sub-pixel group, one second sub-pixel is disposed in a second pixel column of the first sub-pixel group, one third sub-pixel is disposed in a third pixel column of the first sub-pixel group, and two second sub-pixels which are sequentially arranged are disposed in a fourth pixel column of the first sub-pixel group. The second sub-pixel in the second pixel column corresponds to the two first sub-pixels in the first pixel column, and the third sub-pixel in the third pixel column corresponds to the two second sub-pixels in the fourth pixel column.

One third sub-pixel is disposed in a first pixel column of the second sub-pixel group, two second sub-pixels which are sequentially arranged are disposed in a second pixel column of the second sub-pixel group, two first sub-pixels which are sequentially arranged are disposed in a third pixel column of the second sub-pixel group, and one second sub-pixel is disposed in a fourth pixel column of the second sub-pixel group. The third sub-pixel in the first pixel column corresponds to the two second sub-pixels in the second pixel column, and the second sub-pixel in the fourth pixel column corresponds to the two first sub-pixels in the third pixel column.

Alternatively, the first sub-pixel group and the second sub-pixel group are disposed in an overlying relation, and individual pixel columns in the first sub-pixel group are disposed corresponding to individual pixel columns in the second sub-pixel group.

Alternatively, in the first sub-pixel group, the second sub-pixel in the second pixel column and the third sub-pixel in the third pixel column are located in the same pixel row.

Alternatively, in the first sub-pixel group, a light emitting center of the second sub-pixel in the second pixel column and a midpoint of a connecting line between light emitting centers of the two first sub-pixels in the first pixel column are located on the same straight line in a row direction, and a light emitting center of the third sub-pixel in the third pixel column and a midpoint of a connecting line between light emitting centers of the two second sub-pixels in the fourth pixel column are located on the same straight line in a row direction.

Alternatively, in the second sub-pixel group, the third sub-pixel in the first pixel column and the second sub-pixel in the fourth pixel column are located in the same pixel row.

Alternatively, in the second sub-pixel group, a light emitting center of the third sub-pixel in the first pixel column and a midpoint of a connecting line between light emitting centers of the two second sub-pixels in the second pixel column are located on the same straight line in a row direction, and a light emitting center of the second sub-pixel in the fourth pixel column and a midpoint of a connecting line between light emitting centers of the two first sub-pixels in the third pixel column are located on the same straight line in a row direction.

Additionally, the present invention provides a method for driving the above display substrate, and may comprise:

First, according to input values for corresponding sub-pixels in a first sub-pixel group, respectively generating output values for two first sub-pixels in a first pixel column, an output value for one second sub-pixel in a second pixel column, an output value for one third sub-pixel in a third pixel column and output values for two second sub-pixels in a fourth pixel column.

Second, respectively outputting the output values for the two first sub-pixels in the first pixel column, the output value for the one second sub-pixel in the second pixel column, the output value for the one third sub-pixel in the third pixel column and the output values for the two second sub-pixels in the fourth pixel column, which are generated as above.

Third, according to input values for corresponding sub-pixels in a second sub-pixel group, respectively generating an output value for one third sub-pixel in a first pixel column, output values for two second sub-pixels in a second pixel column, output values for two first sub-pixels in a third pixel column, and an output value for one second sub-pixel in a fourth pixel column.

Fourth, respectively outputting the output value for the one third sub-pixel in the first pixel column, the output values for the two second sub-pixels in the second pixel column, the output values for the two first sub-pixels in the third pixel column, and the output value for the one second sub-pixel in the fourth pixel column, which are generated as above.

Alternatively, the step of, according to input values for corresponding sub-pixels in a first sub-pixel group, respectively generating output values for two first sub-pixels in a first pixel column, an output value for one second sub-pixel in a second pixel column, an output value for one third sub-pixel in a third pixel column and output values for two second sub-pixels in a fourth pixel column, comprises:

First, according to two first sub-pixel input values corresponding to each first sub-pixel in the first pixel column of the first sub-pixel group, generating an output value for each first sub-pixel in the first pixel column.

Second, according to two second sub-pixel input values corresponding to the second sub-pixel in the second pixel column of the first sub-pixel group, generating an output value for the second sub-pixel in the second pixel column.

Third, according to four third sub-pixel input values corresponding to the third sub-pixel in the third pixel column of the first sub-pixel group, generating an output value for the third sub-pixel in the third pixel column. and Fourth, according to a second sub-pixel input value corresponding to each second sub-pixel in the fourth pixel column of the first sub-pixel group, generating an output value for each second sub-pixel in the fourth pixel column.

Alternatively, the step of, according to two first sub-pixel input values corresponding to each first sub-pixel in the first pixel column of the first sub-pixel group, generating an output value for each first sub-pixel in the first pixel column, comprises: by dividing a sum of two first sub-pixel input values corresponding to each first sub-pixel in the first pixel column of the first sub-pixel group by two, generating an output value for each first sub-pixel in the first pixel column;

the step of, according to two second sub-pixel input values corresponding to the second sub-pixel in the second pixel column of the first sub-pixel group, generating an output value for the second sub-pixel in the second pixel column, comprises: by dividing a sum of two second sub-pixel input values corresponding to the second sub-pixel in the second pixel column of the first sub-pixel group by two, generating an output value for the second sub-pixel in the second pixel column;

the step of, according to four third sub-pixel input values corresponding to the third sub-pixel in the third pixel column of the first sub-pixel group, generating an output value for the third sub-pixel in the third pixel column, comprises: by dividing a sum of four third sub-pixel input values corresponding to the third sub-pixel in the third pixel column of the first sub-pixel group by four, generating an output value for the third sub-pixel in the third pixel column; and the step of, according to a second sub-pixel input value corresponding to each second sub-pixel in the fourth pixel column of the first sub-pixel group, generating an output value for each second sub-pixel in the fourth pixel column, comprises: setting a second sub-pixel input value corresponding to each second sub-pixel in the fourth pixel column of the first sub-pixel group to an output value for each second sub-pixel in the fourth pixel column.

Alternatively, the step of, according to input values for corresponding sub-pixels in a second sub-pixel group, respectively generating an output value for one third sub-pixel in a first pixel column, output values for two second sub-pixels in a second pixel column, output values for two first sub-pixels in a third pixel column, and an output value for one second sub-pixel in a fourth pixel column, comprises:

according to four third sub-pixel input values corresponding to the third sub-pixel in the first pixel column of the second sub-pixel group, generating an output value for the third sub-pixel in the first pixel column;

according to a second sub-pixel input value corresponding to each second sub-pixel in the second pixel column of the second sub-pixel group, generating an output value for each second sub-pixel in the second pixel column;

according to two first sub-pixel input values corresponding to each first sub-pixel in the third pixel column of the second sub-pixel group, generating an output value for each first sub-pixel in the third pixel column; and according to two second sub-pixel input values corresponding to the second sub-pixel in the fourth pixel column of the second sub-pixel group, generating an output value for the second sub-pixel in the fourth pixel column.

Alternatively, the step of, according to four third sub-pixel input values corresponding to the third sub-pixel in the first pixel column of the second sub-pixel group, generating an output value for the third sub-pixel in the first pixel column, comprises: by dividing a sum of four third sub-pixel input values corresponding to the third sub-pixel in the first pixel column of the second sub-pixel group by four, generating an output value for the third sub-pixel in the first pixel column;

the step of, according to a second sub-pixel input value corresponding to each second sub-pixel in the second pixel column of the second sub-pixel group, generating an output value for each second sub-pixel in the second pixel column, comprises: setting a second sub-pixel input value corresponding to each second sub-pixel in the second pixel column of the second sub-pixel group to an output value for each second sub-pixel in the second pixel column;

the step of, according to two first sub-pixel input values corresponding to each first sub-pixel in the third pixel column of the second sub-pixel group, generating an output value for each first sub-pixel in the third pixel column, comprises: by dividing a sum of two first sub-pixel input values corresponding to each first sub-pixel in the third pixel column of the second sub-pixel group by two, generating an output value for each first sub-pixel in the third pixel column; and the step of, according to two second sub-pixel input values corresponding to the second sub-pixel in the fourth pixel column of the second sub-pixel group, generating an output value for the second sub-pixel in the fourth pixel column, comprises: by dividing a sum of two second sub-pixel input values corresponding to the second sub-pixel in the fourth pixel column of the second sub-pixel group by two, generating an output value for the second sub-pixel in the fourth pixel column.

The present invention has the following advantageous effects:

In a technical solution of the display substrate and the driving method thereof as well as the display apparatus, which are provided by the present invention, each pixel group comprises a first sub-pixel group and a second sub-pixel group; in the first sub-pixel group, a second sub-pixel in a second pixel column corresponds to two first sub-pixels in a first pixel column such that the two first sub-pixels share one second sub-pixel and a third sub-pixel in a third pixel column corresponds to two second sub-pixels in a fourth pixel column such that the two second sub-pixels share one third sub-pixel; moreover, in the second sub-pixel group, a third sub-pixel in a first pixel column corresponds to two first sub-pixels in a second pixel column such that the two second sub-pixels share one third sub-pixel, and a second sub-pixel in a fourth pixel column corresponds to two first sub-pixels in a third pixel column such that the two first sub-pixels share one second sub-pixel. In this way, the present invention reduces the number of first sub-pixels, second sub-pixels and third sub-pixels in each pixel group, thereby reducing the number of sub-pixels in the whole display apparatus. Therefore, on a premise of ensuring that the display apparatus achieves a relatively high resolution, the fabrication difficulty of the display apparatus is reduced, and the cost is lowered.

BRIEF DESCRIPTION OF THE DRAWINGS

FIG. 1 is a schematic structural view of a display substrate provided by an embodiment I of the present invention.

DETAILED DESCRIPTION OF THE INVENTION

To enable a person having ordinary skilled in the art to better understand a technical solution of the present invention, a display substrate and a driving method thereof as well as a display apparatus, which are provided by the present invention, will be hereafter be described in detail in connection with the accompanying drawings.

FIG. 1 is a schematic structural view of a display substrate provided by an embodiment I of the present invention. As shown in FIG. 1, the display substrate comprises pixel groups 1 which are arranged repeatedly, each pixel group 1 comprising a first sub-pixel group 2 and a second sub-pixel group 3, and the first sub-pixel group 2 and the second sub-pixel group 3 both comprising four pixel columns. Two first sub-pixels 11 which are sequentially arranged are disposed in a first pixel column of the first sub-pixel group 2, one second sub-pixel 12 is disposed in a second pixel column of the first sub-pixel group 2, one third sub-pixel 13 is disposed in a third pixel column of the first sub-pixel group 2, and two second sub-pixels 12 which are sequentially arranged are disposed in a fourth pixel column of the first sub-pixel group 2, wherein the second sub-pixel 12 in the second pixel column corresponds to the two first sub-pixels 11 in the first pixel column, and the third sub-pixel 13 in the third pixel column corresponds to the two second sub-pixels 12 in the fourth pixel column. One third sub-pixel 13 is disposed in a first pixel column of the second sub-pixel group, two second sub-pixels 12 which are sequentially arranged are disposed in a second pixel column of the second sub-pixel group, two first sub-pixels 11 which are sequentially arranged are disposed in a third pixel column of the second sub-pixel group, and one second sub-pixel 12 is disposed in a fourth pixel column of the second sub-pixel group, wherein the third sub-pixel 13 in the first pixel column corresponds to the two second sub-pixels 12 in the second pixel column, and the second sub-pixel 12 in the fourth pixel column corresponds to the two first sub-pixels 11 in the third pixel column.

Particularly, the first sub-pixel group 2 and the second sub-pixel group 3 are disposed in an overlying relation, and individual pixel columns in the first sub-pixel group 2 are disposed corresponding to individual pixel columns in the second sub-pixel group 3. In this embodiment, the first sub-pixel group 2 is located over the second sub-pixel group 3, the first pixel column in the first sub-pixel group 2 corresponds to the first pixel column in the second sub-pixel group 3, the second pixel column in the first sub-pixel group 2 corresponds to the second pixel column in the second sub-pixel group 3, the third pixel column in the first sub-pixel group 2 corresponds to the third pixel column in the second sub-pixel group 3, and the fourth pixel column in the first sub-pixel group 2 corresponds to the fourth pixel column in the second sub-pixel group 3.

In this embodiment, in the first sub-pixel group 2, the second sub-pixel 12 in the second pixel column and the third sub-pixel 13 in the third pixel column are located in the same pixel row.

Preferably, in the first sub-pixel group 2, a light emitting center of the second sub-pixel 12 in the second pixel column and a midpoint of a connecting line between light emitting centers of the two first sub-pixels 12 in the first pixel column are located on the same straight line in a row direction, and a light emitting center of the third sub-pixel 13 in the third pixel column and a midpoint of a connecting line between light emitting centers of the two second sub-pixels 12 in the fourth pixel column are located on the same straight line in a row direction.

In this embodiment, in the second sub-pixel group 3, the third sub-pixel 13 in the first pixel column and the second sub-pixel 12 in the fourth pixel column are located in the same pixel row.

Preferably, in the second sub-pixel group 3, a light emitting center of the third sub-pixel 13 in the first pixel column and a midpoint of a connecting line between light emitting centers of the two second sub-pixels 12 in the second pixel column are located on the same straight line in a row direction, and a light emitting center of the second sub-pixel 12 in the fourth pixel column and a midpoint of a connecting line between light emitting centers of the two first sub-pixels 11 in the third pixel column are located on the same straight line in a row direction.

In this embodiment, preferably, the first sub-pixel 11 is a red sub-pixel R, the second sub-pixel 12 is a green sub-pixel G, and the third sub-pixel 13 is a blue sub-pixel B. Here, the sub-pixels in the display substrate are arranged in accordance with a RG/BG arrangement. In a practical application, the first sub-pixel 11, the second sub-pixel 12 and the third sub-pixel 13 may also be sub-pixels of other colors, which will not be enumerated herein.

Hereinafter, a calculation method of output values for individual sub-pixels in the display substrate provided by this embodiment will be described in detail in reference to one particular example. In this embodiment, it will be described by using a situation where the first sub-pixel 11 is the red sub-pixel R, the second sub-pixel 12 is the green sub-pixel G and the third sub-pixel 13 is the blue sub-pixel B as an example.

Because each pixel group 1 comprises four first sub-pixels 11, six second sub-pixels 12 and two third sub-pixels 13, R:G:B=2:3:1. In this embodiment, the total number of input values for input signals corresponding to all sub-pixels on the display substrate is $M \times N \times 3$. That is, the input signals comprise $M \times N$ first sub-pixel input values, $M \times N$ second sub-pixel input values and $M \times N$ third sub-pixel input values, wherein M is the row resolution, and N is the column resolution. A replace ratio (abbreviated PR) of the display substrate in display is 1.5. Accordingly, the total number of output values for output signals of all sub-pixels on the display substrate is $M \times N \times 3/2$, wherein the replace ratio 1.5 means that 1.5 sub-pixels are employed to represent one pixel. Because R:G:B is 2:3:1, in the display substrate, the number of output values for the first sub-pixels 11 is $M \times N \times 3/2 \times 2/6 = M \times N/2$, the number of output values for the second sub-pixels 12 is $M \times N \times 3/2 \times 3/6 = M \times N \times 3/4 = M \times N/2 + M \times N/4$, and the number of output values for the third sub-pixels 13 is $M \times N \times 3/2 \times 1/6 = M \times N/4$.

As can be seen from the above content, the number of output values for the first sub-pixels 11 is ½ of that for the first sub-pixel input values. The number of output values for the second sub-pixel 12 is ¾ of that for the second sub-pixel input values, and the number of output values for the third sub-pixel 13 is ¼ of that for the third sub-pixel input values. Accordingly, as an implementation, the output values for individual sub-pixels may be calculated by employing the following calculation method. It is to be noted that, in a practical application, the output values for individual sub-pixels may also be calculated by employing other calculation methods, which will not be enumerated.

An output value for each first sub-pixel 11 in a first pixel column of the first sub-pixel group 2 is a value obtained by dividing a sum of two first sub-pixel input values corresponding to each first sub-pixel 11 in the first pixel column by two. Particularly, the two first sub-pixel input values corresponding to first sub-pixels 11 are respectively Rin(i, 2(j−1)) and Rin(i, 2j−1), then its output value is Routij=(Rin(i, 2(j−1))+Rin(i, 2j−1))/2, wherein i is the number of rows and 1≤i≤M, and j is the number of columns and 1≤j≤N/2. Accordingly, an output value for the first one of first sub-pixels 11 in the first pixel column is Rout11=(Rin10+Rin11)/2=(0+Rin11)/2=Rin11/2, and an output value for the second one of first sub-pixels 11 in the first pixel column is Rout21=(Rin20+Rin21)/2=(0+Rin21)/2=Rin21/2. It is to be noted that, when j=1, Rin(i, 2(j−1))=Rin(i, 0)=0. For remaining pixel groups, an output value for the first sub-pixels 11 in the first pixel column of the first sub-pixel group 2 may be deduced in a similar way, which will not be particularly described herein.

An output value for the second sub-pixel 12 in the second pixel column of the first sub-pixel group 2 is a value obtained by dividing a sum of output values for two second sub-pixel input values corresponding to the second sub-pixel 12 in the second pixel column by two. Particularly, two second sub-pixel input values corresponding to the second sub-pixel 12 are respectively Gin(2i−1, 2j−1) and Gin(2i, 2j−1), then its output value is G1_outij=(Gin(2i−1, 2j−1)+Gin(2i, 2j−1))/2, wherein i is the number of rows and 1≤i≤M, j is the number of columns and 1≤j≤N/2, and i is an odd number. Accordingly, an output value for the second sub-pixel 12 in the second pixel column is G1_out11=(Gin11+Gin21)/2. For remaining pixel groups, an output value for the second sub-pixel 12 in the second pixel column of the first sub-pixel group 2 may be deduced in a similar way, which will not be particularly described herein.

An output value for the third sub-pixel 13 in the third pixel column of the first sub-pixel group 2 is a value obtained by dividing a sum of four third sub-pixel input values corresponding to the third sub-pixel 13 in the third pixel column by four. Particularly, the four third sub-pixel input values corresponding to the third sub-pixel 13 are respectively Bin(2i−1, 2j−1), Bin(2i−1, 2j), Bin(2i, 2j−1) and Bin(2i, 2j), then its output value is Boutij=(Bin(2i−1, 2j−1)+Bin(2i−1, 2j)+Bin(2i, 2j−1)+Bin(2i, 2j))/4, wherein i is the number of rows and 1≤i≤M, and j is the number of columns and 1≤j≤N/2. Accordingly, an output value for the third sub-pixel 13 in the third pixel column is Bout11=(Bin11+Bin12+Bin21+Bin22)/4. For remaining pixel groups, an output value for the third sub-pixel 13 in the third pixel column of the first sub-pixel group 2 may be deduced in a similar way, which will not be particularly described herein.

An output value for each second sub-pixel 12 in the fourth pixel column of the first sub-pixel group 2 is a second sub-pixel input value corresponding to each second sub-pixel 12 in the fourth pixel column. Particularly, the second sub-pixel input value corresponding to the second sub-pixel 12 is Gin(i, 2j), then its output value is G2_outij=Gin(i, 2j), wherein i is the number of rows and 1≤i≤M, and j is the number of columns and 1≤j≤N/2. Accordingly, an output value for the first one of second sub-pixels 12 in the fourth pixel column is G2_out11=Gin12, and an output value for the second one of second sub-pixels 12 in the fourth pixel column is G2_out21=Gin22. For remaining pixel groups, an output value for the second sub-pixel 12 in the fourth pixel column of the first sub-pixel group 2 may be deduced in a similar way, which will not be particularly described herein.

An output value for the third sub-pixel 13 in the first pixel column of the second sub-pixel group 3 is a value obtained by dividing a sum of four third sub-pixel input values corresponding to the third sub-pixel 13 in the first pixel column by four. Particularly, the four third sub-pixel input values corresponding to the third sub-pixel 13 are respectively Bin(2i−1, 2j−1), Bin(2i−1, 2j), Bin(2i, 2j−1) and Bin(2i, 2j), then its output value is Boutij=(Bin(2 i−1, 2j−1)+Bin(2 i−1, 2j)+Bin(2i, 2j−1)+Bin(2i, 2j))/4, wherein i is the number of rows and 1≤i≤M, and j is the number of columns and 1≤j≤N/2. Accordingly, an output value for the third sub-pixel 13 in the first pixel column is Bout21=(Bin31+Bin32+Bin41+Bin42)/4. For remaining pixel groups, an output value for the third sub-pixel 13 in the first pixel column of the second sub-pixel group 3 may be deduced in a similar way, which will not be particularly described herein.

An output value for each second sub-pixel in the second pixel column of the second sub-pixel group 3 is a second sub-pixel input value corresponding to each second sub-pixel in the second pixel column. Particularly, the second sub-pixel input value corresponding to the second sub-pixel 12 is Gin(i, 2j), then its output value is G2_outij=Gin(i, 2j), wherein i is the number of rows and 1≤i≤M, and j is the number of columns and 1≤j≤N/2. Accordingly, an output value for the first one of second sub-pixels 12 in the second pixel column is G2_out31=Gin32, and an output value for the second one of second sub-pixels 12 in the second pixel column is G2_out41=Gin42. For remaining pixel groups, an output value for the second sub-pixel 12 in the second pixel column of the second sub-pixel group 3 may be deduced in a similar way, which will not be particularly described herein.

An output value for each first sub-pixel 11 in a third pixel column of the second sub-pixel group 3 is a value obtained by dividing a sum of two first sub-pixel input values corresponding to each first sub-pixel 11 in the third pixel column by two. Particularly, the two first sub-pixel input values corresponding to each first sub-pixel 11 are respectively Rin (i, 2(j−1)) and Rin(i, 2j−1), then its output value is Routij=Rin(i,2(j−1))+Rin(i, 2j−1))/2, wherein i is the number of rows and 1≤i≤M, and j is the number of columns and 1≤j≤N/2. Accordingly, an output value for the first one of first sub-pixels 11 in the third pixel column is Rout31=(Rin30+Rin31)/2=(0+Rin31)/2=Rin31/2, and an output value for the second one of first sub-pixel 11 in the third pixel column is Rout41=(Rin40+Rin41)/2=(0+Rin41)/2=Rin41/2. It is to be noted that, when j=1, Rin(i, 2(j−1))=Rin(i, 0)=0. For remaining pixel groups, an output value for the first sub-pixel 11 in the third pixel column of the second sub-pixel group 3 may be deduced in a similar way, which will not be particularly described herein.

An output value for the second sub-pixel 12 in the fourth pixel column of the second sub-pixel group 3 is a value obtained by dividing a sum of two second sub-pixel input values corresponding to the second sub-pixel 12 in the fourth pixel column by two. Particularly, the two second sub-pixel input values corresponding to the second sub-pixel 12 are respectively Gin(2i−1, 2j) and Gin(2i, 2j), then its output value is G1_outij=(Gin(2i−1, 2j)+Gin(2i, 2j))/2, wherein i is the number of rows and 1≤i≤M, j is the number of columns and 1≤j≤N/2, and i is an even number. Accordingly, an output value for the second sub-pixel 12 in the fourth pixel column is G1 out21=(Gin32+Gin42)/2. For remaining pixel groups, an output value for the second sub-pixel 12 in the fourth pixel column of the second sub-pixel group 3 may be deduced in a similar way, which will not be particularly described herein.

Compared with a RG/BG pixel arrangement in the prior art, by means of a RG/BG pixel arrangement of the display substrate in this embodiment, the number of first sub-pixels, second sub-pixels and third sub-pixels is reduced. In the first sub-pixel group 2 of this embodiment, the second sub-pixel corresponds to two first sub-pixels in the adjacent pixel column such that the two first sub-pixels share one second sub-pixel, and the third sub-pixel corresponds to two second sub-pixels in the adjacent pixel column such that the two second sub-pixels share one third sub-pixel. Moreover, a similar situation is suitable for the second sub-pixel group 3 of this embodiment. Accordingly, on the basis of reducing the number of first sub-pixels, second sub-pixels and third sub-pixels, the RG/BG pixel arrangement is similarly formed.

In some embodiments, an image simulation display test and a black-white line display test are performed on the display substrate of this embodiment, and results show that the display substrate of this embodiment achieves a better resolution. Accordingly, in this embodiment, although the number of first sub-pixels, second sub-pixels and third sub-pixels is reduced, a better resolution may be achieved by fitting the above suitable algorithm. Because the number of first sub-pixels, second sub-pixels and third sub-pixels, especially the number of third sub-pixels, is reduced, the display substrate of this embodiment is especially suitable for a display apparatus with an ultrahigh resolution. When applied to the display apparatus with an ultrahigh resolution, the display substrate of this embodiment may reduce an influence caused by reduction of the number of the sub-pixels.

This embodiment, each pixel group comprises a first sub-pixel group and a second sub-pixel group. In the first sub-pixel group, a second sub-pixel in a second pixel column corresponds to two first sub-pixels in a first pixel column such that the two first sub-pixels share one second sub-pixel, and a third sub-pixel in a third pixel column corresponds to two second sub-pixels in a fourth pixel column such that the two second sub-pixels share one third sub-pixel. Moreover, in the second sub-pixel group, a third sub-pixel in a first pixel column corresponds to two second sub-pixels in a second pixel column such that the two second sub-pixels share one third sub-pixel, and a second sub-pixel in a fourth pixel column corresponds to two first sub-pixels in a third pixel column such that the two first sub-pixels share one second sub-pixel. In this way, this embodiment reduces the number of first sub-pixels, second sub-pixels and third sub-pixels in each pixel group, thereby reducing the number of sub-pixels in the whole display apparatus. Therefore, on a premise of ensuring that the display apparatus achieves a relatively high resolution, the fabrication difficulty of the display apparatus is reduced, and the cost is lowered.

Another embodiment of the present invention provides a display apparatus. The display apparatus comprises a display substrate. The display substrate may employ a display substrate provided by the above embodiment—, which will be omitted herein.

In this embodiment, the display apparatus may comprise a liquid crystal display apparatus or an organic light-emitting diode (abbreviated OLED) display apparatus.

In this embodiment, each pixel group comprises a first sub-pixel group and a second sub-pixel group. In the first sub-pixel group, a second sub-pixel in a second pixel column corresponds to two first sub-pixels in a first pixel column such that the two first sub-pixels share one second sub-pixel, and a third sub-pixel in a third pixel column corresponds to two second sub-pixels in a fourth pixel column such that the two second sub-pixels share one third sub-pixel. Moreover, in the second sub-pixel group, a third sub-pixel in a first pixel column corresponds to two second sub-pixels in a second pixel column such that the two second sub-pixels share one third sub-pixel, and a second sub-pixel in a fourth pixel column corresponds to two first sub-pixels in a third pixel column such that the two first sub-pixels share one second sub-pixel. In this way, this embodiment reduces the number of first sub-pixels, second sub-pixels and third sub-pixels in each pixel group, thereby reducing the number of sub-pixels in the whole display apparatus. Therefore, on a premise of ensuring that the display apparatus achieves a relatively high resolution, the fabrication difficulty of the display apparatus is reduced, and the cost is lowered.

Yet another embodiment of the present invention provides a method for driving a display substrate. The method may be used to drive the display substrate provided by the first embodiment described herein.

The method comprises:

Step 101: according to input values for corresponding sub-pixels in a first sub-pixel group, respectively generating output values for two first sub-pixels in a first pixel column, an output value for one second sub-pixel in a second pixel column, an output value for one third sub-pixel in a third pixel column and output values for two second sub-pixels in a fourth pixel column.

In this embodiment, the step 101 may particularly comprise:

Step 1011: according to two first sub-pixel input values corresponding to each first sub-pixel in the first pixel column of the first sub-pixel group, generating an output value for each first sub-pixel in the first pixel column.

Particularly, by dividing a sum of two first sub-pixel input values corresponding to each first sub-pixel in the first pixel column of the first sub-pixel group by two, generating an output value for each first sub-pixel in the first pixel column.

Step 1012: according to two second sub-pixel input values corresponding to the second sub-pixel in the second pixel column of the first sub-pixel group, generating an output value for the second sub-pixel in the second pixel column.

Particularly, by dividing a sum of two second sub-pixel input values corresponding to the second sub-pixel in the second pixel column of the first sub-pixel group by two, generating an output value for the second sub-pixel in the second pixel column.

Step 1013: according to four third sub-pixel input values corresponding to the third sub-pixel in the third pixel column of the first sub-pixel group, generating an output value for the third sub-pixel in the third pixel column.

Particularly, by dividing a sum of four third sub-pixel input values corresponding to the third sub-pixel in the third pixel column of the first sub-pixel group by four, generating an output value for the third sub-pixel in the third pixel column.

Step 1014: according to a second sub-pixel input value corresponding to each second sub-pixel in the fourth pixel column of the first sub-pixel group, generating an output value for each second sub-pixel in the fourth pixel column.

Particularly, setting a second sub-pixel input value corresponding to each second sub-pixel in the fourth pixel column of the first sub-pixel group to an output value for each second sub-pixel in the fourth pixel column.

Step 102: respectively outputting the output values for the two first sub-pixels in the first pixel column, the output value for the one second sub-pixel in the second pixel column, the output value for the one third sub-pixel in the third pixel column and the output values for the two second sub-pixels in the fourth pixel column, which are generated as above.

Step 103: according to input values for corresponding sub-pixels in a second sub-pixel group, respectively generating an output value for one third sub-pixel in a first pixel column, output values for two second sub-pixels in a second pixel column, output values for two first sub-pixels in a third pixel column, and an output value for one second sub-pixel in a fourth pixel column.

In this embodiment, the step 103 may particularly comprise:

Step 1031: according to four third sub-pixel input values corresponding to the third sub-pixel in the first pixel column of the second sub-pixel group, generating an output value for the third sub-pixel in the first pixel column.

Particularly, by dividing a sum of four third sub-pixel input values corresponding to the third sub-pixel in the first pixel column of the second sub-pixel group by four, generating an output value for the third sub-pixel in the first pixel column.

Step 1032: according to a second sub-pixel input value corresponding to each second sub-pixel in the second pixel column of the second sub-pixel group, generating an output value for each second sub-pixel in the second pixel column.

Particularly, setting a second sub-pixel input value corresponding to each second sub-pixel in the second pixel column of the second sub-pixel group to an output value for each second sub-pixel in the second pixel column.

Step 1033: according to two first sub-pixel input values corresponding to each first sub-pixel in the third pixel column of the second sub-pixel group, generating an output value for each first sub-pixel in the third pixel column.

Particularly, by dividing a sum of two first sub-pixel input values corresponding to each first sub-pixel in the third pixel column of the second sub-pixel group by two, generating an output value for each first sub-pixel in the third pixel column.

Step 1034: according to two second sub-pixel input values corresponding to the second sub-pixel in the fourth pixel column of the second sub-pixel group, generating an output value for the second sub-pixel in the fourth pixel column.

Particularly, by dividing a sum of two second sub-pixel input values corresponding to the second sub-pixel in the fourth pixel column of the second sub-pixel group by two, generating an output value for the second sub-pixel in the fourth pixel column.

Step 104: respectively outputting the output value for the one third sub-pixel in the first pixel column, the output values for the two second sub-pixels in the second pixel column, the output values for the two first sub-pixels in the third pixel column, and the output value for the one second sub-pixel in the fourth pixel column, which are generated as above.

A sequence from the above step 1011 to the above step 1014 may be arbitrarily changed, and may be simultaneously performed, which will not be defined herein. Similarly, a sequence from the above step 1031 to the above step 1034 may be arbitrarily changed, and may be simultaneously performed, which will not be defined herein.

The method for driving the display substrate, which is provided by this embodiment, may be used to drive the display substrate provided by the first embodiment, wherein a detailed description of the display substrate may refer to the first embodiment.

In this embodiment, each pixel group comprises a first sub-pixel group and a second sub-pixel group; in the first sub-pixel group, a second sub-pixel in a second pixel column corresponds to two first sub-pixels in a first pixel column such that the two first sub-pixels share one second sub-pixel, and a third sub-pixel in a third pixel column corresponds to two second sub-pixels in a fourth pixel column such that the two second sub-pixels share one third sub-pixel. Moreover, in the second sub-pixel group, a third sub-pixel in a first pixel column corresponds to two second sub-pixels in a second pixel column such that the two second sub-pixels share one third sub-pixel, and a second sub-pixel in a fourth pixel column corresponds to two first sub-pixels in a third pixel column such that the two first sub-pixels share one second sub-pixel. In this way, this embodiment reduces the number of first sub-pixels, second sub-pixels and third sub-pixels in each pixel group, thereby reducing the number of sub-pixels in the whole display apparatus. Therefore, on a premise of ensuring that the display apparatus achieves a relatively high resolution, the fabrication difficulty of the display apparatus is reduced, and the cost is lowered.

It may be understood that, the above implementation is merely an exemplary implementation employed for illustrating the principle of the present invention. However, the present invention is not limited to this. Many modifications and variations will be made by those skilled in the art without departing from the spirit and the essence of the present invention, and are also included within a protection scope of the present invention.

The invention claimed is:

1. A display substrate, comprising pixel groups which are arranged repeatedly, each pixel group comprising a first sub-pixel group and a second sub-pixel group, and said first sub-pixel group and said second sub-pixel ground both comprising four sub-pixel columns; wherein two first sub-pixels which are sequentially arranged are disposed in a first sub-pixel column of said first sub-pixel group, one second sub-pixel is disposed in a second sub-pixel column of said first sub-pixel group, one third sub-pixel is disposed in a third sub-pixel column-in said first sub-pixel group, and two second sub-pixels which are sequentially arranged are disposed in a fourth sub-pixel column of said first sub-pixel group, wherein said second sub-pixel in said second sub-pixel column corresponds to said two first sub-pixels in said first pixel column, and said third sub-pixel in said third sub-pixel column corresponds to said two second sub-pixels in said fourth pixel column; and one third sub-pixel is disposed in a first sub-pixel column of said second sub-pixel group, two second sub-pixels which are sequentially arranged are disposed in a second sub-pixel column of said second sub-pixel group, two first sub-pixels which are sequentially arranged are disposed in a third sub-pixel column of said second sub-pixel group, and one second sub-pixel is disposed in a fourth sub-pixel column of said second sub-pixel group, wherein said third sub-pixel in said first sub-pixel column corresponds to said two second sub-pixels in said second pixel column, and said second sub-pixel in said fourth sub-pixel column corresponds to said two first sub-pixels in said third pixel column wherein in said first sub-pixel group, a light emitting center of said second sub-pixel in said second sub-pixel column and a midpoint of a connecting line between light emitting centers of said two first sub-pixels in said first sub-pixel column are located on the same straight line in a row direction, and a light emitting center of said third sub-pixel in said third sub-pixel column and a midpoint of a connecting line between light emitting centers of said two second sub-pixels in said fourth sub-pixel column are located on the same straight line in a row direction; and wherein in said second sub-pixel group, a light emitting center of said third sub-pixel in said first sub-pixel column and a midpoint of a connecting line between light emitting centers of said two second sub-pixels in said second sub-pixel column are located on the same straight line in a row direction, and a light emitting center of said second sub-pixel in said fourth sub-pixel column and a midpoint of a connecting line between light emitting centers of said two first sub-pixels in said third sub-pixel column are located on the same straight line in a row direction.

2. The display substrate according to claim 1, wherein said first sub-pixel group and said second sub-pixel group are disposed in an overlying relation, and wherein individual sub-pixel columns in said first sub-pixel group are disposed corresponding to individual sub-pixel columns in said second sub-pixel group.

3. A display apparatus, comprising the display substrate according to claim 2.

4. The display substrate according to claim 1, wherein in said first sub-pixel group, said second sub-pixel in said second pixel column, and said third sub-pixel in said third sub-pixel column are located in the same pixel row.

5. A display apparatus, comprising the display substrate according to claim 4.

6. The display substrate according to claim 1, wherein in said second sub-pixel group, said third sub-pixel in said first sub-pixel column and said second sub-pixel in said fourth sub-pixel column are located in the same pixel row.

7. A display apparatus, comprising the display substrate according to claim 6.

8. A display apparatus, comprising the display substrate according to claim 1.

9. A method for driving the display substrate according to claim 1, comprising:

according to input values for corresponding sub-pixels in said first sub-pixel group, respectively generating output values for said two first sub-pixels in said first pixel column, an output value for said one second sub-pixel in said second pixel column, an output value for said one third sub-pixel in said third sub-pixel column and output values for said two second sub-pixels in said fourth pixel column;

respectively outputting said output values for said two first sub-pixels in said first pixel column, said output value for said one second sub-pixel in said second pixel column, said output value for said one third sub-pixel in said third sub-pixel column and said output values for said two second sub-pixels in said fourth pixel column, which are generated as above;

according to input values for corresponding sub-pixels in said second sub-pixel group, respectively generating an output value for said one third sub-pixel in said first pixel column, output values for said two second sub-pixels in said second pixel column, output values for said two first sub-pixels in said third pixel column, and an output value for said one second sub-pixel in said fourth pixel column; and respectively outputting said output value for said one third sub-pixel in said first pixel column, said output values for said two second sub-pixels in said second pixel column, said output values for said two first sub-pixels in said third pixel column, and said output value for said one second sub-pixel in said fourth pixel column, which are generated as above.

10. The method according to claim 9, wherein the step of, according to input values for corresponding sub-pixels in said first sub-pixel group, respectively generating output values for said two first sub-pixels in said first pixel column, an output value for said one second sub-pixel in said second pixel column, an output value for said one third sub-pixel in said third sub-pixel column and output values for said two second sub-pixels in said fourth pixel column, comprises:

according to two first sub-pixel input values corresponding to each first sub-pixel in said first sub-pixel column of said first sub-pixel group, generating an output value for each first sub-pixel in said first pixel column;

according to two second sub-pixel input values corresponding to said second sub-pixel in said second sub-pixel column of said first sub-pixel group, generating an output value for said second sub-pixel in said second pixel column;

according to four third sub-pixel input values corresponding to said third sub-pixel in said third sub-pixel column of said first sub-pixel group, generating an output value for said third sub-pixel in said third pixel column; and according to a second sub-pixel input value corresponding to each second sub-pixel in said fourth sub-pixel column of said first sub-pixel group, generating an output value for each second sub-pixel in said fourth pixel column.

11. The method according to claim 10, wherein the step of, according to two first sub-pixel input values corresponding to each first sub-pixel in said first sub-pixel column of said first sub-pixel group, generating an output value for each first sub-pixel in said first pixel column, comprises: by dividing a sum of two first sub-pixel input values corresponding to each first sub-pixel in said first sub-pixel column of said first sub-pixel group by two, generating an output value for each first sub-pixel in said first pixel column;

the step of, according to two second sub-pixel input values corresponding to said second sub-pixel in said second sub-pixel column of said first sub-pixel group, generating an output value for said second sub-pixel in said second pixel column, comprises: by dividing a sum of two second sub-pixel input values corresponding to said second sub-pixel in said second sub-pixel column of said first sub-pixel group by two, generating an output value for said second sub-pixel in said second pixel column;

the step of, according to four third sub-pixel input values corresponding to said third sub-pixel in said third sub-pixel column of said first sub-pixel group, generating an output value for said third sub-pixel in said third pixel column, comprises: by dividing a sum of the four third sub-pixel input values corresponding to said third sub-pixel in said third sub-pixel column of said first sub-pixel group by four, generating an output value for said third sub-pixel in said third pixel column; and the step of, according to a second sub-pixel input value corresponding to each second sub-pixel in said fourth sub-pixel column of said first sub-pixel group, generating an output value for each second sub-pixel in said fourth pixel column, comprises: setting a second sub-pixel input value corresponding to each second sub-pixel in said fourth sub-pixel column of said first sub-pixel group to an output value for each second sub-pixel in said fourth pixel column.

12. The method according to claim 9, wherein the step of, according to input values for corresponding sub-pixels in said second sub-pixel group, respectively generating an output value for said one third sub-pixel in said first pixel column, output values for said two second sub-pixels in said second pixel column, output values for said two first sub-pixels in said third pixel column, and an output value for said one second sub-pixel in said fourth pixel column, comprises:

according to four third sub-pixel input values corresponding to said third sub-pixel in said first sub-pixel column of said second sub-pixel group, generating an output value for said third sub-pixel in said first pixel column;

according to a second sub-pixel input value corresponding to each second sub-pixel in said second sub-pixel column of said second sub-pixel group, generating an output value for each second sub-pixel in said second pixel column;

according to two first sub-pixel input values corresponding to each first sub-pixel in said third sub-pixel column of said second sub-pixel group, generating an output value for each first sub-pixel in said third pixel column; and according to two second sub-pixel input values corresponding to said second sub-pixel in said fourth sub-pixel column of said second sub-pixel group, generating an output value for said second sub-pixel in said fourth pixel column.

13. The method according to claim 12, wherein the step of, according to four third sub-pixel input values corresponding to said third sub-pixel in said first sub-pixel column of said second sub-pixel group, generating an output value for said third sub-pixel in said first pixel column, comprises: by dividing a sum of four third sub-pixel input values corresponding to said third sub-pixel in said first sub-pixel column of said second sub-pixel group by four, generating an output value for said third sub-pixel in said first pixel column;

the step of, according to a second sub-pixel input value corresponding to each second sub-pixel in said second sub-pixel column of said second sub-pixel group, generating an output value for each second sub-pixel in said second pixel column, comprises: setting a second sub-pixel input value corresponding to each second sub-pixel in said second sub-pixel column of said second sub-pixel group to an output value for each second sub-pixel in said second pixel column;

the step of, according to two first sub-pixel input values corresponding to each first sub-pixel in said third sub-pixel column of said second sub-pixel group, generating an output value for each first sub-pixel in said third pixel column, comprises: by dividing a sum of two first sub-pixel input values corresponding to each first sub-pixel in said third of said second sub-pixel group by two, generating an output value for each first sub-pixel in said third pixel column; and the step of, according to two second sub-pixel input values corresponding to said second sub-pixel in said fourth sub-pixel column of said second sub-pixel group, generating an output value for said second sub-pixel in said fourth pixel column, comprises: by dividing a sum of two second sub-pixel input values corresponding to said second sub-pixel in said fourth sub-pixel column of said second sub-pixel group by two, generating an output value for said second sub-pixel in said fourth pixel column.

* * * * *